US007721782B2

(12) United States Patent
Foley et al.

(10) Patent No.: US 7,721,782 B2
(45) Date of Patent: May 25, 2010

(54) ARCHED WINDOW COVERING

(75) Inventors: Patrick E. Foley, Winston Salem, NC (US); Brian B. Johnson, Statesville, NC (US)

(73) Assignee: Newell Window Furnishings, Inc., High Point, NC (US)

( * ) Notice: Subject to any disclaimer, the term of this patent is extended or adjusted under 35 U.S.C. 154(b) by 626 days.

(21) Appl. No.: 11/550,843

(22) Filed: Oct. 19, 2006

(65) Prior Publication Data

US 2008/0093032 A1 Apr. 24, 2008

(51) Int. Cl.
*E06B 3/94* (2006.01)

(52) U.S. Cl. ..... 160/134; 160/84.07; 160/84.06; 160/172 R; 160/168.1 V; 160/173 V; 160/277; 248/276.1; 49/41

(58) Field of Classification Search ..... 160/134, 160/84.07, 84.06, 172 R, 168.1 V, 173 V, 160/277; 248/276.1, 288.31, 288.11; 49/41
See application file for complete search history.

(56) References Cited

U.S. PATENT DOCUMENTS

| | | | | | |
|---|---|---|---|---|---|
| 602,967 | A | * | 4/1898 | Wells | 160/134 |
| 1,609,877 | A | * | 12/1926 | Kendall | 160/84.07 |
| 4,699,195 | A | * | 10/1987 | Lester | 160/134 |
| 4,776,380 | A | | 10/1988 | Lester | |
| 4,934,436 | A | * | 6/1990 | Schnebly | 160/84.07 |
| 5,010,939 | A | * | 4/1991 | King | 160/84.07 |
| 5,117,889 | A | | 6/1992 | Coe | |
| 5,139,070 | A | * | 8/1992 | Kidd | 160/84.07 |
| 5,159,966 | A | | 11/1992 | Fleishman et al. | |
| 5,168,912 | A | * | 12/1992 | Jelic et al. | 160/84.07 |
| 5,183,092 | A | * | 2/1993 | Jelic | 160/84.07 |
| 5,205,337 | A | * | 4/1993 | Bozzo | 160/84.01 |
| 5,662,153 | A | | 9/1997 | Rosenblatt | |
| 5,794,680 | A | * | 8/1998 | Xue | 160/84.07 |
| 6,029,733 | A | * | 2/2000 | Xue | 160/84.07 |
| 6,145,569 | A | * | 11/2000 | Shaw et al. | 160/84.07 |
| 6,390,172 | B1 | | 5/2002 | Fleishman et al. | |
| 6,408,924 | B1 | * | 6/2002 | Anderson et al. | 160/168.1 V |
| 6,651,722 | B1 | * | 11/2003 | Fleishman et al. | 160/168.1 V |
| 6,820,674 | B2 | | 11/2004 | Abita et al. | |
| 6,877,546 | B1 | * | 4/2005 | Garcia | 160/134 |
| 6,983,784 | B2 | * | 1/2006 | Anderson et al. | 160/168.1 V |
| 7,048,027 | B1 | * | 5/2006 | Abita | 160/84.07 |
| 7,188,658 | B1 | * | 3/2007 | Nordstrom et al. | 160/84.07 |
| 2004/0112548 | A1 | | 6/2004 | Militello et al. | |
| 2005/0126716 | A1 | | 6/2005 | Militello et al. | |
| 2006/0230575 | A1 | * | 10/2006 | Quinn et al. | 16/87.2 |
| 2007/0084567 | A1 | * | 4/2007 | Chen | 160/84.05 |
| 2007/0284055 | A1 | * | 12/2007 | Liang | 160/84.07 |
| 2008/0093031 | A1 | * | 4/2008 | Alberti | 160/84.07 |
| 2008/0135188 | A1 | * | 6/2008 | DeBauche | 160/84.06 |
| 2009/0194240 | A1 | * | 8/2009 | Liang et al. | 160/168.1 R |

* cited by examiner

*Primary Examiner*—Katherine W Mitchell
*Assistant Examiner*—Philip S Kwon
(74) *Attorney, Agent, or Firm*—Dennis J. Williamson; Moore & Van Allen, PLLC

(57) ABSTRACT

The arched window covering comprises a head rail that is mounted to an architectural feature. A mounting track is mounted to the arched architectural feature and a slider track is snap fit to the mounting track. The slider track includes support portions extending therefrom that slidably support a plurality of sliders such that the sliders can be moved relative to the slider track. The sliders are connected to a shade panel such that movement of the sliders on the slider track results in the extension and retraction of the shade panel.

24 Claims, 8 Drawing Sheets

ARCHED WINDOW COVERING

BACKGROUND OF THE INVENTION

Moveable window coverings such as blinds, shades and the like are well known. One type of window covering is the cellular or honeycomb shade. This type of window covering typically comprises a rectanguler shade panel constructed of woven or non-woven material formed into a plurality of contiguous cells. In cross-section, the cells typically have a polygonal shape such as a heptagon. The cells provide insulation and prevent light penetration. Plural layers of cells may be used in the panel to increase the insulating and light impermeability characteristics of the panel.

In a typical bottom up shade, the shade panel is supported along its upper edge by a head rail and has its lower edge secured to a bottom rail. The head rail is secured to an architectural feature such as a window frame to support the window covering adjacent to the architectural feature being covered. A plurality of lift cords extend from the head rail and are connected to the bottom rail to raise and lower the bottom rail thereby opening and closing the window covering. In one typical arrangement the lift cords are connected to draw cords that extend from the head rail such that they can be grasped by a person to cause the blinds to raise and lower. It is also known to use a spring motor or an electric motor to raise and lower the blinds. As the blind panel is moved from an extended or closed position to a retracted or open position, the panel material folds to collapse the cells against the head rail. Such window shades are suitable for use on rectangular architectural features such as doors or windows. However such shades are not suitable for use on arched architectural features such as arched windows or the like.

Arched window coverings are known. However, the known arched window coverings are complex and expensive to manufacture or do not perform well when installed. The window covering should be easily and smoothly extended and retracted to selectively cover and uncover the architectural feature and relatively inexpensive and simple to manufacture. Moreover, the window covering must be able to be adapted to various arch shapes and sizes.

Thus, an improved arched window covering is desired.

SUMMARY OF THE INVENTION

The arched window covering of the invention comprises a head rail that is mounted to a wall, window frame, door or other architectural feature. A mounting track is mounted to the arched architectural feature and a slider track is snap fit to the mounting track. The slider track includes support portions extending therefrom that slidably support a plurality of sliders such that the sliders can be moved relative to the slider track. The sliders are connected to a shade panel such that movement of the sliders on the slider track results in the extension and retraction of the shade panel. The shade panel may comprise a cellular shade formed to have an arched shape with radially extending cells. A ball joint is formed on one of the sliders that can be engaged by a control wand such that the opening and closing of the shade may be accomplished from a distance to allow the window covering to be mounted in hard to reach areas.

DETAILED DESCRIPTION OF EMBODIMENTS OF THE INVENTION

Figure 1:
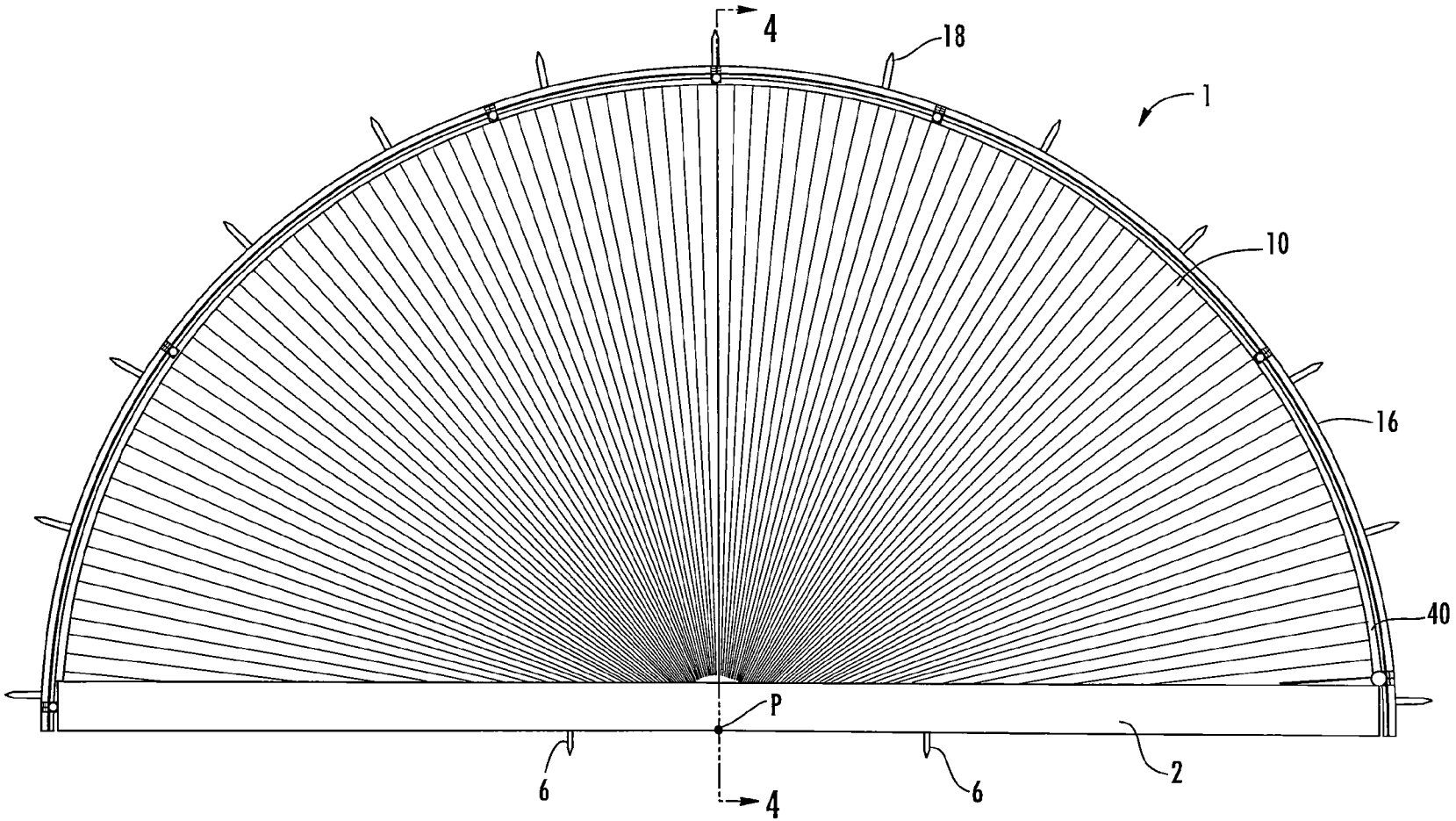
FIG. 1 is an elevation view of an embodiment of an arch window covering of the invention.

The window covering of the invention is shown generally at 1 in FIGS. 1, 2, 3 and 4 and includes a head rail or valance 2 made of a rigid material such as aluminum, wood or the like. The head rail 2 is typically mounted to an architectural feature 4 such as an arched window such that the window covering may selectively cover the architectural feature. While the window covering 1 is shown with an arched window it is to be understood that the architectural feature may be a door, alcove or any other feature. The head rail 2 is typically secured to the architectural feature using screws 6 or other fastener although any mounting mechanism may be used. The head rail 2 includes a channel 3 that extends for substantially the entire length of the head rail and is dimensioned to receive the shade panel 10 as will hereinafter be described.

In the illustrated embodiment the shade panel 10 is a cellular shade where a plurality of contiguous cells 12 extend radially along a line extending from a central point P to create an arched configuration. The shade 10 panel moves about axis P as it is opened and closed. The panel 10 may be made of a woven or non-woven material that is constructed to form the cells 12 where the cells have a polygonal cross-sectional shape. Each cell 12 is formed of a plurality of faces 12*a* that are joined at fold lines such that the cell can collapse when the shade is retracted and expand when the shade is extended. While cells 12 having six faces are illustrated it is to be understood that the cells may have a fewer or greater number of faces and that the specific shape of the cells can vary. The interior of each cell 12 is typically open although it is known to include additional layers of material inside the cells to increase thermal insulation or light impermeability. Moreover, while a single cell configuration is illustrated the shade of the invention may be configured as a double or triple cell shade. A double cell configuration has two layers of cells while a triple cell configuration has three layers of cells. The cellular panel 10 may be created by any known method and is typically made by stitching, gluing, mechanically fastening or otherwise joining multiple pieces of the material together to form the cells. Moreover while a cellular shade panel is illustrated it is to be understood that the panel 12 may have other constructions. For example the shade may be a pleated shade, slatted shade or the like.

The shade panel 10 may be created from a standard rectangular shade panel where the panel is "fanned" to create the arched window covering. Specifically, the top edge of the rectangular panel forms first end 10*a*, the bottom edge of the rectangular panel forms second end 10*b*, one side of the rectangular panel forms curved free edge 10*c* and the other side of the rectangular panel forms an inner curved edge 10*d*. In the illustrated embodiment the shade panel 10 is fanned about point P to create a centrally located void 14 defined by inner edge 10*d*. The shade panel 10 as formed has a partial annular shape. The void 14 is substantially covered by the head rail 2 when the shade is closed to limit the amount of light that can pass through the window covering. A separate valance 11 may be provided to provide a decorative finish to the window covering where the valance also covers void 14.

The first end 10*a* of shade panel 10 is located at one end of head rail 2 in channel 3 and the second end 10*b* is located at the opposite end of head rail 2 in channel 3 such that the shade panel extends for substantially the entire length of the head rail. One end of the shade panel, either first end 10*a* or second end 10*b*, may be fixed to the head rail with the opposite end free to move relative thereto such that the shade can be opened and closed from the free end. The end of the shade panel 10 that is fixed to head rail 2 may be secured thereto using any suitable connection device such as adhesive, two sided tape, mechanical fastener or the like.

Alternatively, both ends 10*a* and 10*b* of shade panel 10 may be free to move relative to the head rail 2 such that the shade may be opened and closed from either or both ends of the shade panel to create a split shade. The split shade arrangement also allows both ends of the shade panel to be moved toward one another such that when the shade is opened, the shade panel is retracted to a central portion of the window.

To support the free edge of the panel 10*c* for movement of the shade, a mounting track 16 is secured to the arched surface of the architectural feature 4 by fasteners such as screws 18. The mounting track 16 extends for the length of the architectural feature 4 and may be made flexible so as to be able to fit arches having different shapes.

Figure 5:
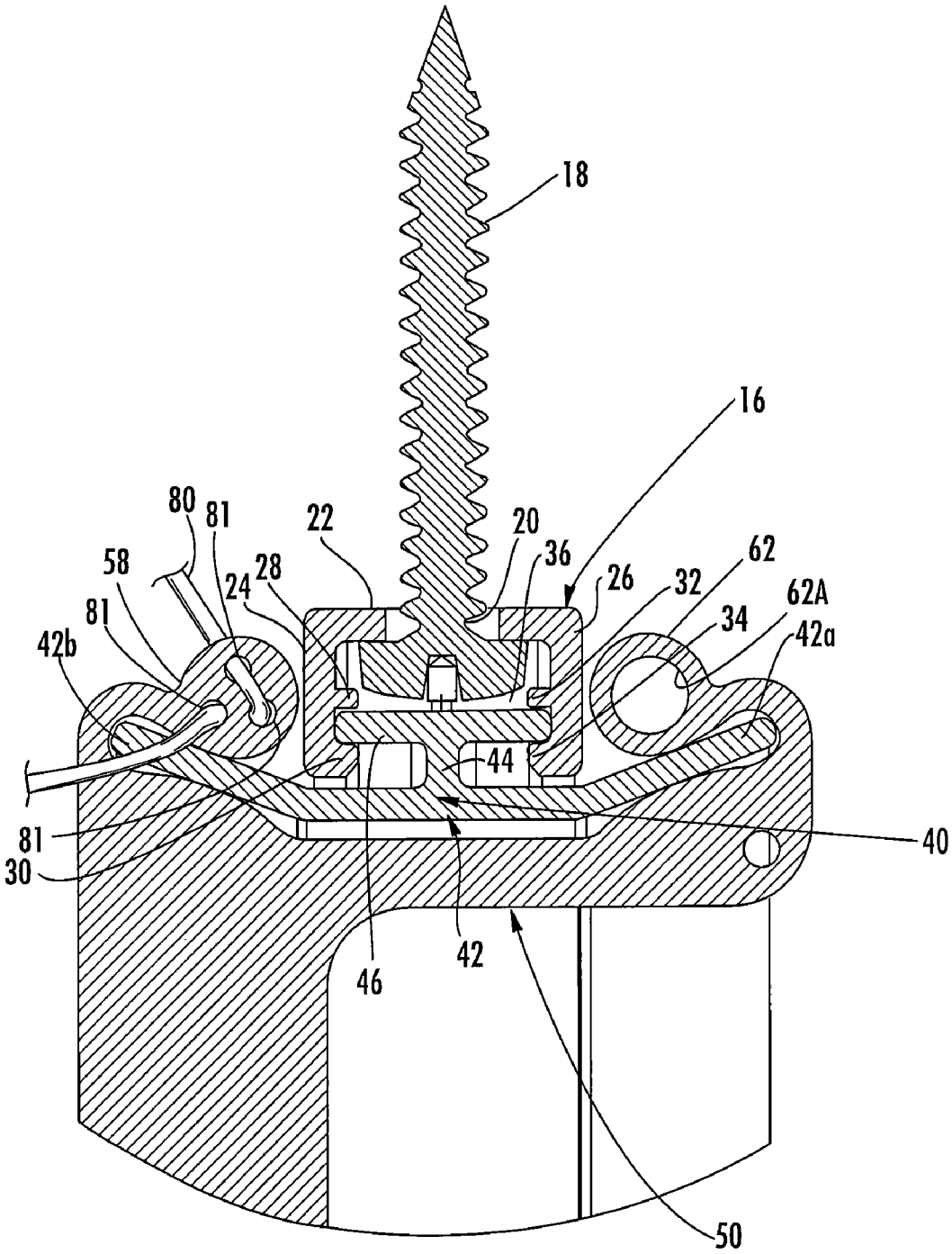
FIG. 5 is an enlarged view of portion B of FIG. 4.

Referring to FIG. 5, the mounting track 16 comprises a base portion 22 that extends for substantially the length of the architectural feature 4 and includes apertures 20 for receiving the fasteners 18. The base portion 22 abuts the architectural feature to which the track is mounted. Extending from the base portion 22 for substantially the entire length thereof is a first side wall 24 and a second side wall 26. The first sidewall 24 includes a first flange 28 and a second flange 30 extending therefrom approximately perpendicularly to sidewall 24. Likewise, the second side wall 26 includes a first flange 32 and a second flange 34 extending therefrom approximately perpendicularly to sidewall 26 and opposed to the flanges 28 and 30 extending from the first sidewall 24. The first sidewall 24, second sidewall 26 and flanges 28, 30, 32 and 34 define an interior space 36 for receiving a mating flange formed on the slider track 40 as will hereinafter be described.

The slider track 40 may be made of a flexible material such as molded plastic and extends for substantially the length of the mounting track 16. Slider track 40 comprises a track portion 42 that includes a first support portion 42*a* that extends beyond one sidewall of the mounting track 16 and a second support portion 42*b* that extends beyond the other sidewall of the mounting track 16. The support portions 42*a* and 4*b* are angled slightly towards the mounting track 16 and are rigid enough to support the shade panel 10. A rib 44 connects the track portion 42 to a flange 46 that extends along the track portion 42 for substantially the length of the slider track 40. Flange 46 is dimensioned so as to be closely received in the interior space 36 of the mounting track 16. The slider track 40 may be mounted to the mounting track 16 by snapping the flange 46 into the interior space 36. Specifically, the flange 46 and rib 44 of the slider track 40 have a generally T-shape where extending portions of flange 46 are trapped between flanges 28 and 30 and 32 and 34 of mounting track 16. The outer corners of flanges 30 and 34 are beveled to allow flange 46 to spread the flanges 30 and 34 apart far enough to allow the flange 46 to enter space 36. Once flange 46 is located in space 36 the flanges 30 and 34 move back to their original position to lock flange 46 to mounting track 16.

Figure 7:
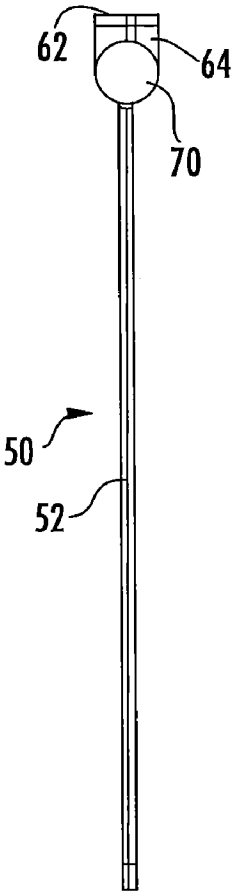
FIG. 7 is a side view showing the slider used in an arched window covering like that illustrated in FIG. 2.
Figure 6:
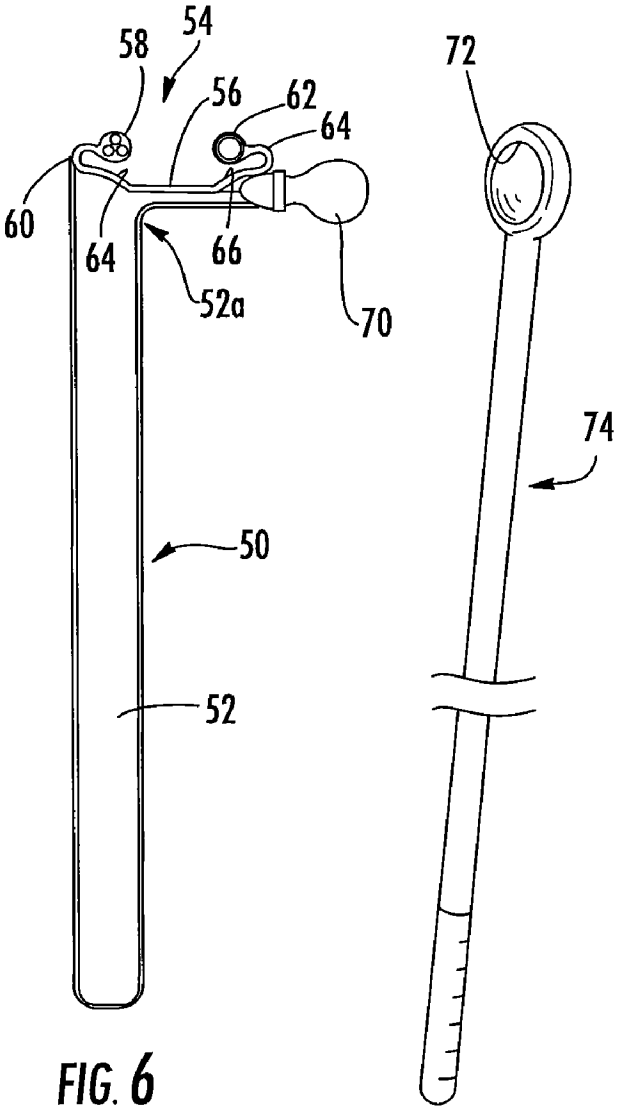
FIG. 6 is a plan view showing the slider used in an arched window covering like that illustrated in FIG. 2.

A plurality of sliders 50 are mounted on the slider track 40 such that they can reciprocate relative to the slider track by sliding on support portions 42*a* and 42*b*. Referring to FIGS. 6 and 7, each slider 50 comprises an elongated member 52 having a relatively flat profile. The elongated member 52 is fixed to the shade panel 10 to support the shade panel for movement relative to the slider track 40. In the illustrated embodiment the elongated member 52 is inserted into one of the cells 12 of the shade panel 10 and is secured thereto by adhesive, staples or the like. Sliders 50 may also be secured to the outside of the shade panel 10. If the shade panel 10 comprises an element other than a cellular shade, the elongated member 52 may be connected to the shade panel 10 other than by insertion into a cell. For example with a pleated shade the slider may be secured to the back surface of the shade. The number of sliders 50 used to support the shade panel 10 will depend on the size, weight and structure of the shade panel. Typically, a slider 50 is located at the apex of the shade panel 10 and in or near the leading cell. The leading cell is the first cell on the movable end of the shade panel. Other sliders 50 may also be used to support the remainder of the shade panel 10.

Attached to the distal end 52*a* of the elongated member 52 and extending at an angle relative thereto is a track engagement structure 54. The track engagement structure 54 may be formed integrally with the elongated member 52 such as by molding a unitary plastic element. Alternatively the components could be formed separately and joined together. The track engagement structure 54 includes a support surface 56. A first bearing surface 58 is mounted to the support surface by a first flange 60 and a second bearing surface 62 is mounted to the support surface by a second flange 64. The bearing surfaces 58 and 62 are spaced from the support surface 56 such that the support track 42 is closely received between the support surface 56 and the bearing surfaces 58 and 62 but where the slider 50 can slide relative to the slider track 40. In one embodiment the support surface 56 defines protrusions 64 and 66 that are opposed to the bearing surfaces 58 and 62, respectively, such that the track portion 42 is closely held therebetween. The track portion 42 also closely fits between flanges 60 and 64 such that lateral movement of the slider 50 relative to the slider track 40 is limited. Sliders 50 extend substantially perpendicularly from slider track 40 such that they extend radially along lines extending from point P.

Figure 4:
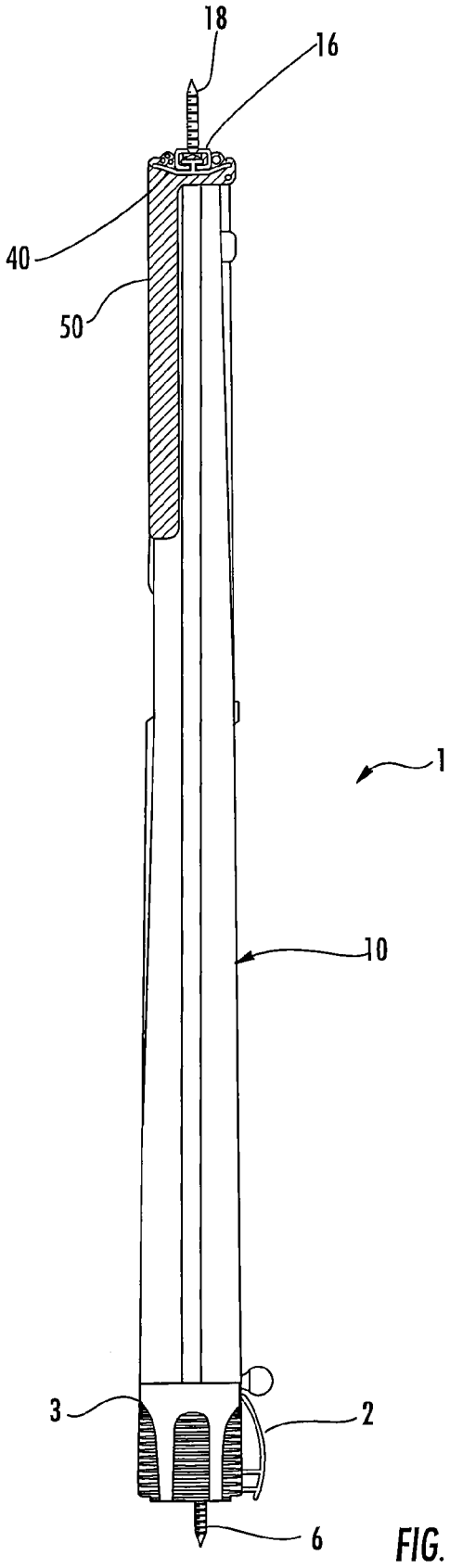
FIG. 4 is a section view taken along line 4-4of FIG. 1.

Selected ones of the sliders 50 are provided with a ball joint 70 that extends from the track engagement structure 54 and is exposed toward the user. Note, the slider of FIGS. 6 and 7 is shown with the ball joint while the slider of FIGS. 4 and 5 is shown without the ball joint. The ball joint 70 may be inserted into the socket 72 of a control wand 74 such that a user may manipulate the control wand to move the shade panel between open and closed positions. Where the shade panel is designed to open only from one end only one end slider is provided with a ball joint. Where the shade panel is designed to open from either end, both of the end sliders are provided with a ball joint. An "end slider" is a slider 50 located near or at either or both ends of the shade panel 10 and is the slider that is manipulated to open or close the shade panel. The control wand is particularly advantageous in those situations where the arched window covering is located in a hard to reach location. If the window covering is accessible to the user the user may manipulate the shade by hand without using the control wand.

Figure 2:
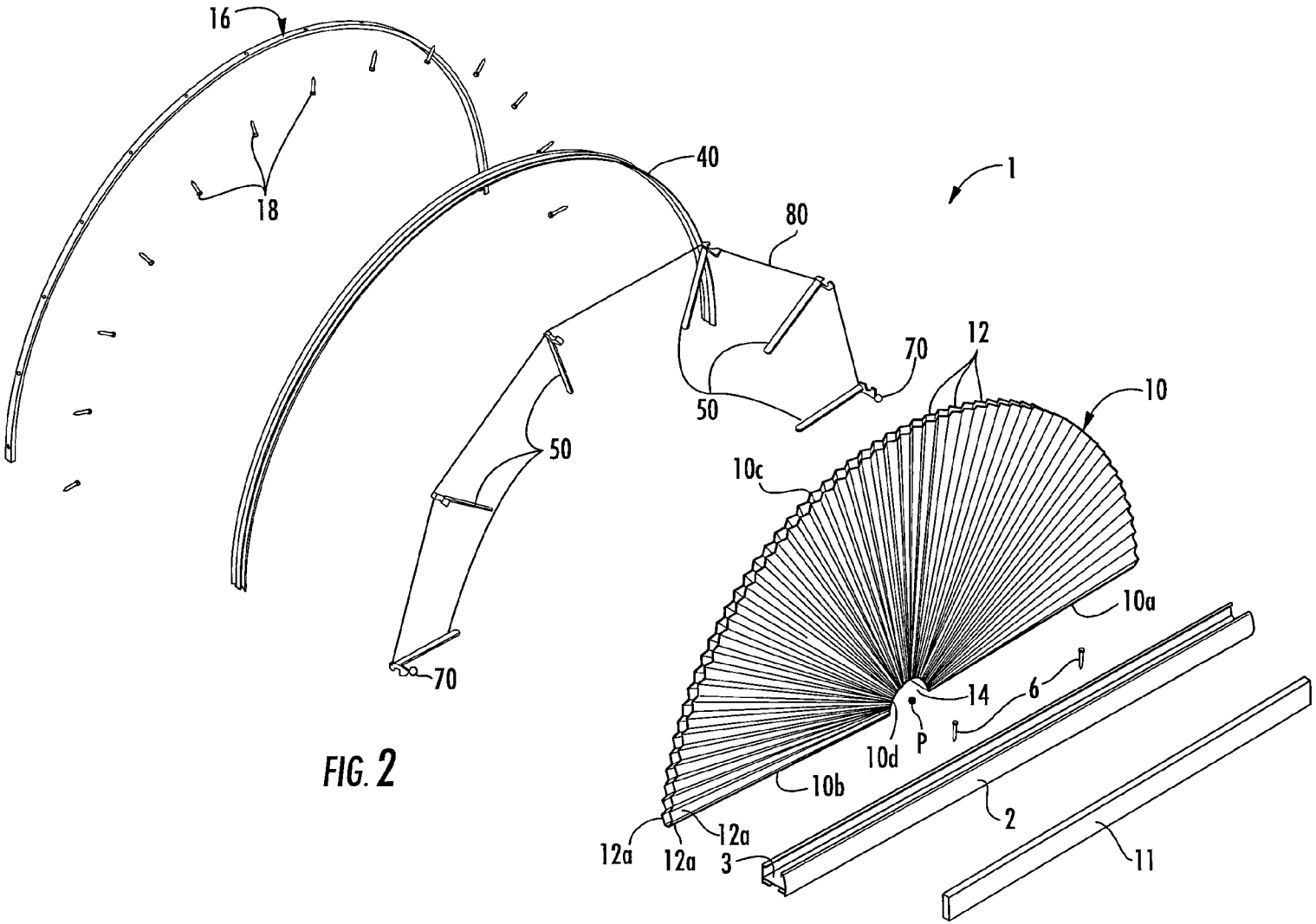
FIG. 2 is an exploded perspective view of an embodiment of the window covering of FIG. 1.
Figure 3:
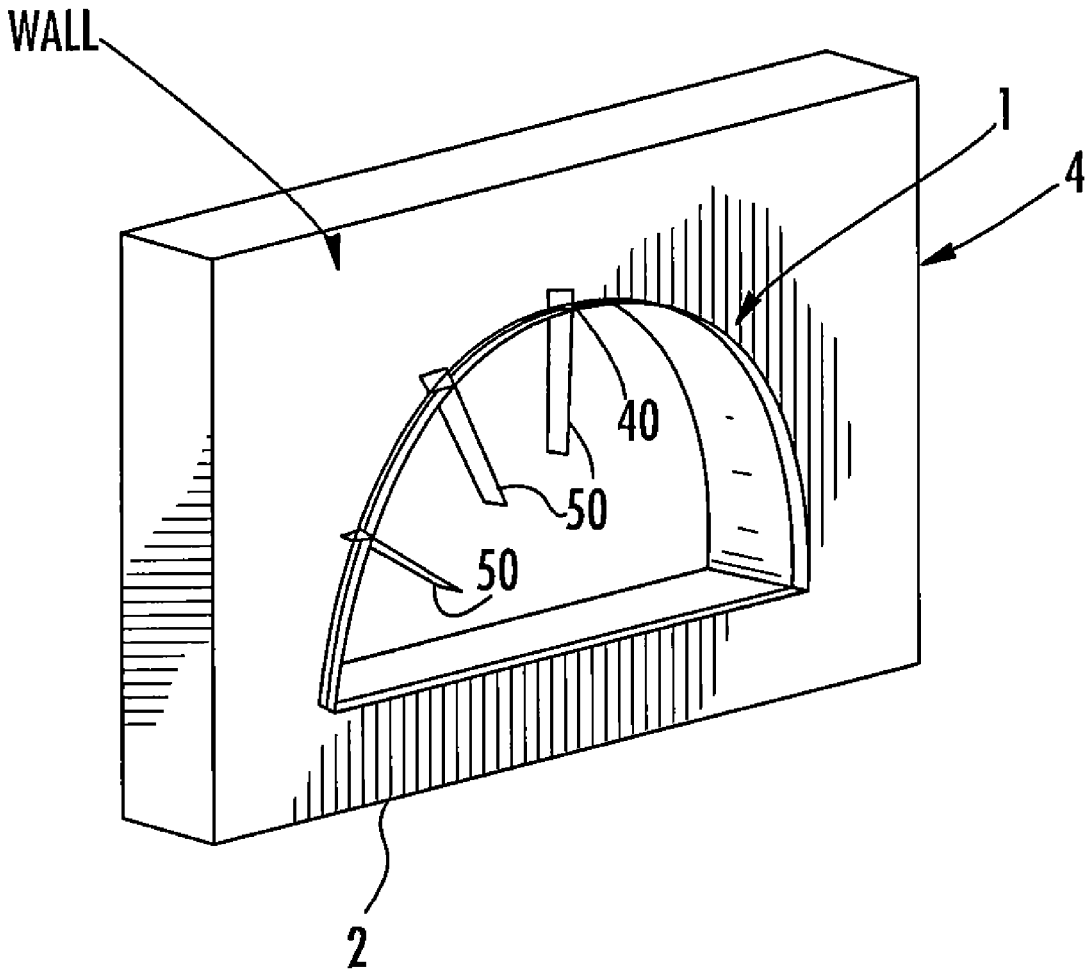
FIG. 3 is a perspective view showing the partially assembled window covering in an arched window.

Referring to FIGS. 2 and 5 to facilitate opening and closing of the shade a cord 80 may be connected between the sliders 50 such that when an end slider is moved, the movement is transmitted to the next adjacent slider via the cord 80. Cord 80 transmits the force to move the shade panel between the sliders 50 such that the shade panel is not subjected to these forces. As best shown in FIG. 5 the cord 80 is disposed above the track portion 42 such that it is hidden from view in the assembled wall covering. To connect the cord 80 to the sliders, slider 50 is provided with three through holes 81 formed in bearing surface 58. Cord 80 is threaded through three holes 81 such that the cord is prevented from moving relative to slider 50. Specifically, cord 80 enters a first hole from a first side of slider 50, passes across the opposite side of the slider and is inserted through a second of the holes, passes across the first side and is inserted through the third hole. A greater number of holes may also be used. Use of the multiple hole connection fixes the cord 80 to the sliders 50 without the need for knots, mechanical fasteners or other connectors.

Figure 8:
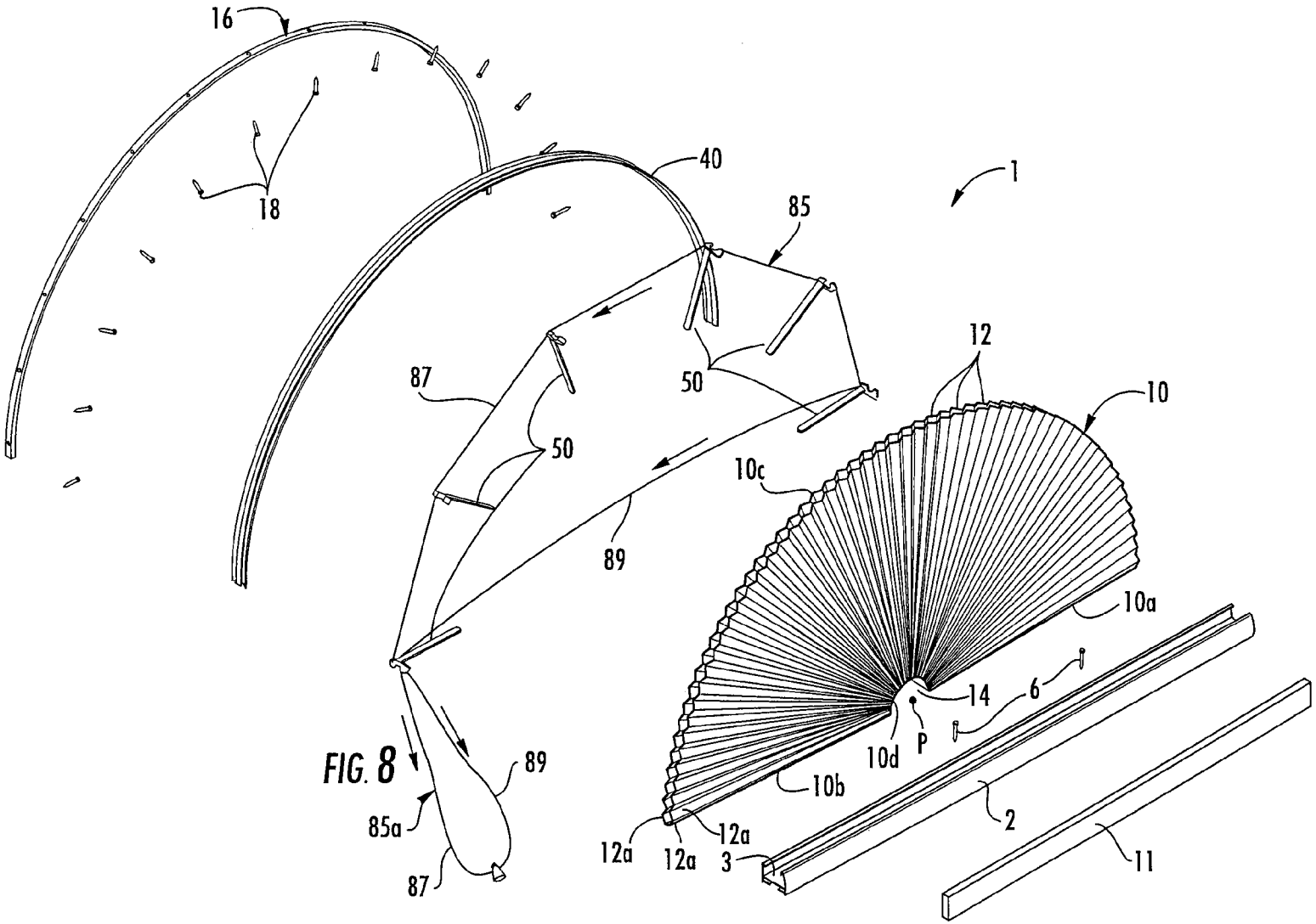
FIG. 8 is an exploded perspective view of another embodiment of the window covering of the invention.

An alternate embodiment of the invention is shown in FIG. 8 where like reference numerals are used to identify like elements previously described with reference to FIGS. 1 through 7. In the embodiment of FIG. 8 a pull cord is used to move the slide panel 10 rather than by hand or using wand 74. Pull cord 85 is threaded through aperture 62*a* formed in bearing surface 62 and is tied or otherwise secured to the end slider that is mounted in the end of shade panel 10 that is intended to move. Pull cord 85 is formed as a loop where a portion 85*a* of the pull cord extends from the window covering where it can be manipulated by a user. Pulling on one leg 87 of the exposed portion 85*a* will retract the shade panel 10 and pulling on the other leg 89 of the portion 85*a* will extend the shade panel 10. For a split shade where both end portions of the shade panel 10 move, two such cords may be used.

Figure 9:
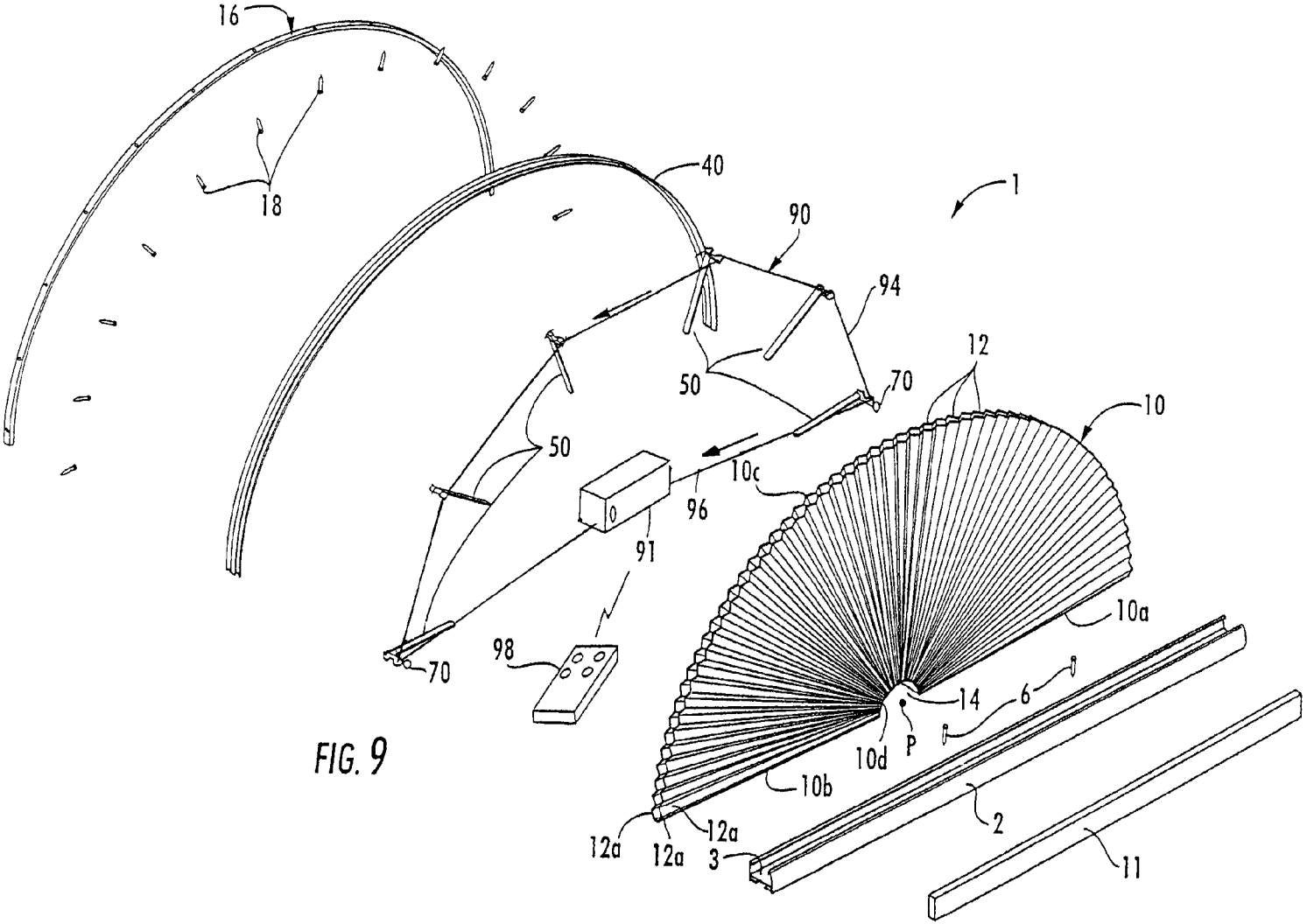
FIG. 9 is an exploded perspective view of yet another embodiment of the window covering of the invention.

An alternate embodiment of the invention is shown in FIG. 9 where like reference numerals are used to identify like elements previously described with reference to FIGS. 1 through 7. In the embodiment of FIG. 9 cord 90 is threaded through aperture 62*a* formed in bearing surface 62 and is tied or otherwise secured to the end slider that is mounted in the end of shade panel 10 that is intended to move. Cord 90 is formed as a loop and is connected to a motor 91 such that actuation of the motor 91 may pull one leg 94 of cord 90 to retract the shade panel 10 and pull the other leg 96 to extend the shade panel 10. Motor 91 may be located in head rail 2. Motor 91 may comprise a reversible electric motor powered by batteries and may be actuated remotely using an infrared or RF remote control 98 or similar remote control device. For a split shade where both end portions of the shade panel 10 move, two such cords may be used.

To install the shade on an architectural feature the mounting track 16 is secured to the architectural feature 4 by fasteners 18. The head rail 2 is also connected to the architectural feature 4 in alignment with the mounting track 16 by fasteners 6. In a typical installation the head rail 2 will be located directly below the mounting track 16 although the actual spatial orientation will depend on the orientation of the architectural feature 4. The sliders 50 are slid onto the end of the slider track 40 and are positioned relative to the shade panel 10. The sliders 50 are connected to the shade panel 10 at spaced intervals using adhesive, staples or the like. With a cellular shade the sliders 50 may be inserted into cells 12. Cord 81, 85 and or 90 may be attached to the sliders 50. Note, cord 80 may be used with either cord 85 or cord 90 such that both cords are attached to sliders 50 as previously described. The first and second ends 10*a* and 10*b* of the shade panel 10 are inserted into channel 3 of the head rail 2 and the slider track 40 is snapped into the mounting track 16. Where motor 91 is used, the motor may be located in head rail 2. One end, either first end 10*a* or second end 10*b*, of the shade panel 10 may be fixed to the head rail 2.

The shade panel 10 may be opened and closed by engaging the ball joint 70 in the socket 72 of the control wand 74 or by physically grasping the ball joint 70 or shade panel 10; by manipulating pull cord 85; or by actuating motor 91. The window covering may be opened by pulling or pushing the first end 10*a* toward the second end 10*b* (or visa versa) such that the sliders 50 slide on slider track 40 to retract the shade panel 10. The shade may be closed by pulling or pushing the first end 10*a* away from the second end 10*b* such that the sliders 50 slide on slider track 40 to expand the shade panel 10. In a split shade design both ends of the shade panel 10*a* and 10*b* are movable such that the ends of the shade panel may be moved to the middle of the window to open the shade. To close the shade both ends of the shade panel are moved toward the head rail 2.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A window covering comprising:

a flexible mounting track, adapted to be secured to an arch, comprising an interior space having a pair of opposed flanges extending into said interior space;

a flexible slider track, mounted to said mounting track, comprising a flange snap fit into said interior space and retained by said opposed flanges, said slider track comprising a first support portion extending beyond a first side of the mounting track and a second support portion extending beyond a second side of the mounting track;

a plurality of sliders mounted on said slider track for movement relative thereto, each of said plurality of sliders comprising a first bearing surface and a second bearing surface spaced to receive the slider track therebetween with the first bearing surface supported by the first support portion and the second bearing surface supported by the second support portion; and a shade panel mounted to said plurality of sliders such that the shade panel moves with said plurality of sliders relative to said slider track.

2. The window covering of claim 1 wherein said plurality of sliders are prevented from moving relative to said slider track in a first direction and a second direction and are free to move relative to said slider track in a third direction.

3. The window covering of claim 2 wherein said third direction is along the length of the slider track.

4. The window covering of claim 1 wherein said plurality of sliders include an elongated member that extends substantially perpendicularly to said slider track and that is attached to said shade panel.

5. The window covering of claim 1 wherein said shade panel is a cellular shade including a plurality of cells and said plurality of sliders are inserted into said plurality of cells.

6. The window covering of claim 5 wherein at least one of said cells is a leading cell and one of said plurality of sliders is inserted into said leading cell.

7. The window covering of claim 1 wherein said shade panel is a rectangular cellular shade.

8. The window covering of claim 7 wherein said rectangular cellular shade is formed into a fan shape.

9. The window covering of claim 7 said shade panel including a first end and a second end wherein said first end of said rectangular cellular shade and a second end of said rectangular cellular shade are supported by a head rail.

10. The window covering of claim 9 wherein said head rail is adapted to be secured to an architectural feature.

11. The window covering of claim 9 wherein said head rail is aligned with said slider track.

12. The window covering of claim 1 wherein a ball joint extends from at least one of said plurality of sliders.

13. The window covering of claim 12 wherein said ball joint is adapted to be releasably inserted into a socket of a control wand.

14. The window covering of claim 1 wherein said plurality of sliders are freely movable relative to said slider track.

15. The window covering of claim 8 wherein said rectangular cellular shade being formed into a fan shape creates a void.

16. The window covering of claim 15 wherein said void is substantially covered by a valance.

17. The window covering of claim 9 wherein said first end is attached to said head rail.

18. The window covering of claim 1 wherein the shade panel has a first end and a second end, both the first end and the second end being movable.

19. The window covering of claim 1 further including a cord connected between the sliders.

20. The window covering of claim 19 wherein said cord is inserted through a plurality of holes on at least one of said sliders.

21. The window covering of claim 1 wherein a pull cord moves at least one of said sliders.

22. The window covering of claim 1 wherein a motor moves at least one of said sliders.

23. The window covering of claim 1 wherein a cord is inserted through at least one of said sliders and is freely movable relative thereto.

24. A method of making a window covering comprising:

attaching a flexible mounting track to an arch, said flexible mounting track comprising an interior space having a pair of opposed flanges extending into said interior space;

snapping a flexible slider track into said interior space, said slide track comprising a first support portion extending beyond a first side of the mounting track and a second support portion extending beyond a second side of the mounting track;

attaching a plurality of sliders to said slider track, each of said plurality of sliders comprising a first bearing surface and a second bearing surface, said first bearing surface and said second bearing surface receiving the slider track therebetween with the first bearing surface supported by the first support portion and the second bearing surface supported by the second support portion;

forming a rectangular shade panel into a fan shape; and attaching one side of said shade panel to said plurality of sliders.

* * * * *